US009327491B2

(12) United States Patent
Kusaka

(10) Patent No.: US 9,327,491 B2
(45) Date of Patent: May 3, 2016

(54) ROTARY SCREEN PRINTING PRESS

(71) Applicant: KOMORI CORPORATION, Tokyo (JP)

(72) Inventor: Akehiro Kusaka, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 14/451,774

(22) Filed: Aug. 5, 2014

(65) Prior Publication Data

US 2015/0040780 A1 Feb. 12, 2015

(30) Foreign Application Priority Data

Aug. 6, 2013 (JP) ..... 2013-163483

(51) Int. Cl.

| | |
|---|---|
| ***B41F 15/08*** | (2006.01) |
| ***B41F 15/44*** | (2006.01) |
| ***B41F 33/08*** | (2006.01) |
| ***B41F 33/10*** | (2006.01) |

(52) U.S. Cl.

CPC ..... *B41F 15/44* (2013.01); *B41F 15/0809* (2013.01); *B41F 33/08* (2013.01); *B41F 33/10* (2013.01)

(58) Field of Classification Search

CPC ..... B41F 15/08; B41F 15/42; B41F 15/44; B41F 15/46; B41F 15/089; B41F 15/0809; B41M 1/12; B41L 13/04; B41L 13/06

USPC ..... 101/116, 120

See application file for complete search history.

(56) References Cited

U.S. PATENT DOCUMENTS

| | | | | |
|---|---|---|---|---|
| 3,557,690 | A * | 1/1971 | Voegelin | 101/120 |
| 4,023,486 | A * | 5/1977 | Linthicum et al. | 101/120 |
| 5,671,671 | A * | 9/1997 | Wyssmann et al. | 101/120 |
| 8,037,817 | B2 * | 10/2011 | Tonosu et al. | 101/216 |
| 2008/0307987 | A1 * | 12/2008 | Umetsu et al. | 101/120 |
| 2009/0165660 | A1 | 7/2009 | Tonosu et al. | |

FOREIGN PATENT DOCUMENTS

| | | | |
|---|---|---|---|
| EP | 0 723 864 | A1 | 7/1996 |
| JP | 2008-201119 | A | 9/2008 |
| JP | 2009-160741 | A | 7/2009 |

OTHER PUBLICATIONS

Extended European Search Report dated Feb. 16, 2015 for Application No. EP 14 17 9970.

* cited by examiner

*Primary Examiner* — Leslie J Evanisko
*Assistant Examiner* — Marissa Ferguson Samreth
(74) *Attorney, Agent, or Firm* — Birch, Stewart, Kolasch & Birch, LLP

(57) ABSTRACT

A rotary screen printing press includes: a sub-frame supporting a screen plate with brackets interposed therebetween, the screen plate being formed in a cylindrical shape; a screen-plate engagement-disengagement cylinder configured to move the sub-frame between a print position and a retreat position; and supporting plates supporting a squeegee in such a way that the squeegee is engageable with and disengageable from the inner periphery of the cylindrical screen plate. The supporting plates are supported on the sub-frame.

2 Claims, 6 Drawing Sheets

ROTARY SCREEN PRINTING PRESS

TECHNICAL FIELD

The present invention relates to a rotary screen printing press which performs screen printing by using a cylindrical screen plate.

BACKGROUND ART

Rotary screen printing presses utilizing a rotary screen unit have heretofore been known as high-speed printing apparatuses for printing objects made from a wide range of materials such as cloth and paper. The rotary screen printing presses employ a printing method involving pushing ink with a squeegee through through-holes formed in the stencil of a screen plate formed in a cylindrical shape to transfer the forced ink onto a printing object.

In general, in such a rotary screen printing press, the squeegee includes a squeegee body (blade) configured to pushing ink, and a support (squeegee bar) supporting the blade. To mount the squeegee on the rotary screen printing press, the squeegee is positioned inside a rotary screen, and opposite end portions of the squeegee bar are fixed to squeegee supporting means. Note that the rotary screen refers to a screen plate formed in a cylindrical shape and having end rings attached to the opposite ends thereof as supporting members.

There had been known a structure in which a conventional rotary screen printing press as described above includes screen-plate supporting means for supporting a rotary screen in such a way that the rotary screen can be engaged with and disengaged from an impression cylinder, and squeegee supporting means supporting the opposite ends of a squeegee bar in such a way that a blade can be engaged with and disengaged from the inner peripheral surface of the rotary screen (see Patent Literature 1, for example).

CITATION LIST

Patent Literatures (Patent Literature 1) Japanese Patent Application Publication No. 2008-201119

(Patent Literature 2) Japanese Patent Application Publication No. 2009-160741

SUMMARY OF INVENTION

Technical Problems

However, according to the invention described in Patent Literature 1 listed above, the screen-plate supporting means and the squeegee supporting means are both supported on frames of the rotary screen printing press. In such a structure, the squeegee supporting means has to support the squeegee bar at positions outside the frames of the rotary screen printing press and distant from the frames. The squeegee bar mounted in this structure measures 2 to 3 m in entire length, and the squeegee measures 13 to 20 kg in weight including the squeegee bar. Thus, the squeegee is a large and heavy object, and its attachment and detachment work imposes a large burden on the operator.

Moreover, in the attachment and detachment work of such a squeegee inside the rotary screen, the operator must put the squeegee into and out of the rotary screen while bearing the weight of the squeegee. Thus, during these operations, the squeegee may possibly contact the rotary screen and the rotary screen or the squeegee may be damaged.

In view of the above, an object of the present invention is to provide a rotary screen printing press with a squeegee which is made shorter in entire length and thereby lighter in weight so that the burden imposes on the operator by attachment and detachment work of the squeegee can be reduced.

Solution to Problem

A rosary screen pointing press according to a first aspect of the invention for solving the above-mentioned problems includes: screen-plate supporting means for supporting a screen plate formed in a cylindrical shape; screen-plate engaging-disengaging means for moving the screen-plate supporting means between a print position and a retreat position; and squeegee supporting means for supporting a squeegee in such a way that the squeegee is engageable with and disengageable from an inner periphery of the screen plate, and the squeegee supporting means is supported on the screen-plate supporting means.

A rotary screen printing press according to a second aspect of the invention for solving the above-mentioned problems is the rotary screen printing press according to the first aspect of the invention, in which the screen-plate supporting means includes a sub-frame supporting opposite ends of the screen plate in an axial direction, and the squeegee supporting means includes supporting plates swingably coupled to the sub-frame and supporting the squeegee.

Advantageous Effect of Invention

According to the rotary screen printing press according to the present invention, the squeegee supporting means is supported on the screen-plate supporting means, and therefore the left and right positions at which the squeegee supporting means supports the squeegee can be closer to each other. In this way, it is possible to minimize the length of the squeegee and therefore reduce the weight of the squeegee. Accordingly, the burden on the operator can be reduced significantly.

DESCRIPTION OF EMBODIMENT

Hereinbelow, a rotary screen printing press according to an embodiment of the present invention will be described in detail with reference to the drawings. Here, it is needless to say that the rotary screen printing press according to this embodiment is not limited to the structure to be described below, and various changes can be made without departing from the gist of the present invention.

Figure 1:
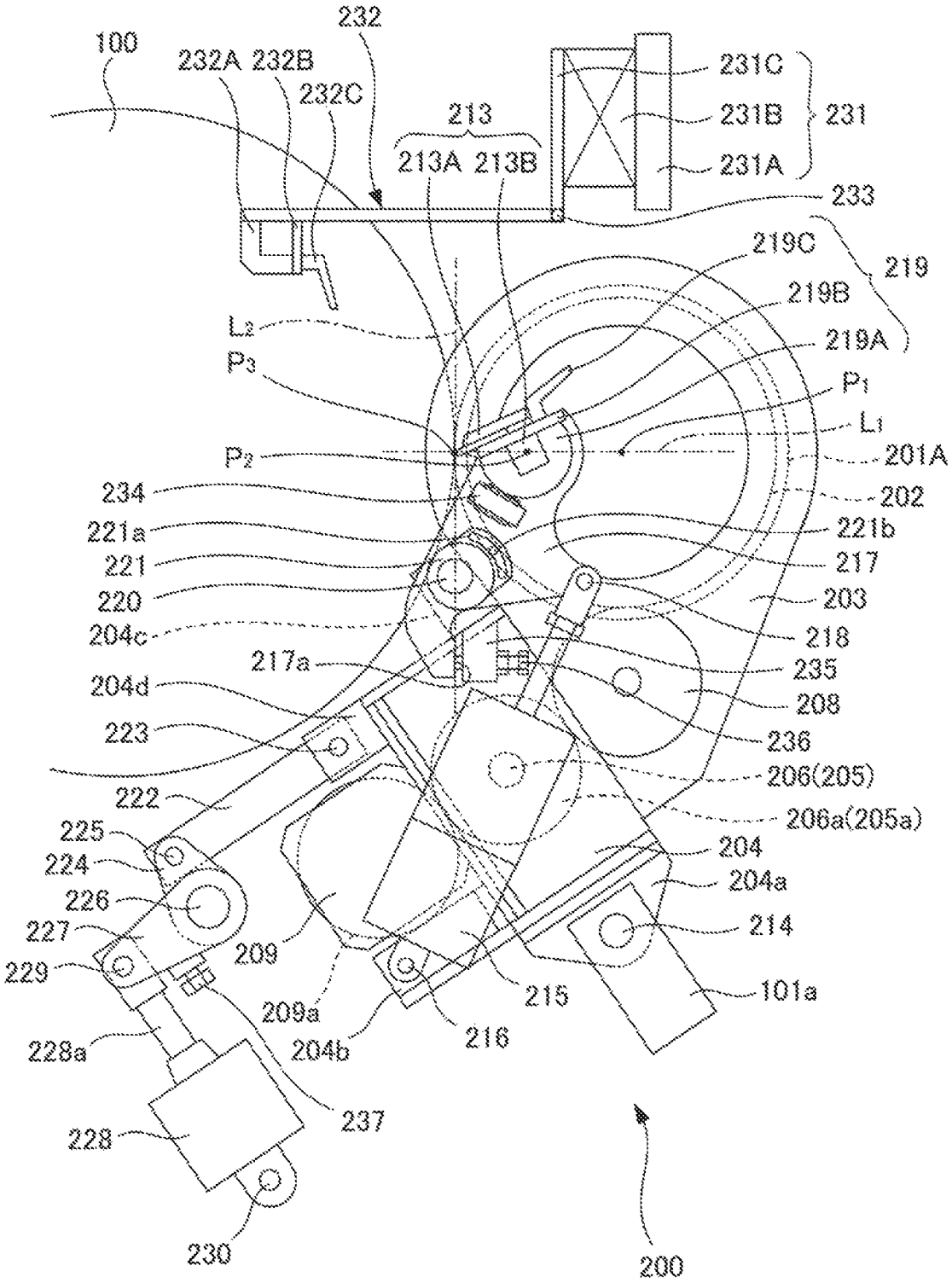
FIG. 1 is an explanatory view showing a rotary screen printing press according to an embodiment of the present invention.
Figure 2:
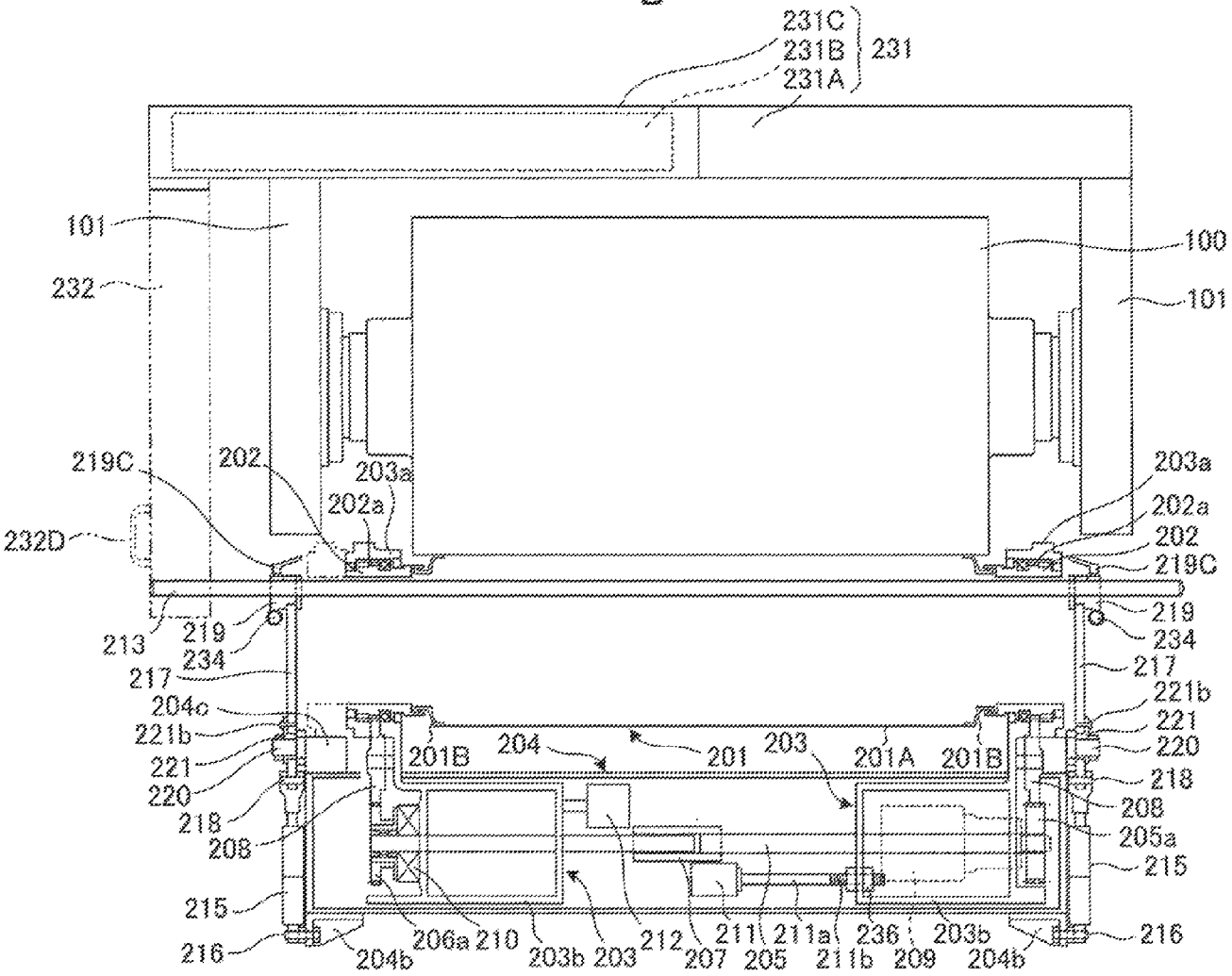
FIG. 2 is a developed plan view of FIG. 1.

As shown in FIGS. 1 and 2, the rotary screen printing press according to this embodiment includes an impression cylinder 100 and a rotary screen unit 200.

The impression cylinder 100 is rotatably supported between left and right frames 101, 101. Though not illustrated, a notched portion is formed in the outer peripheral surface of the impression cylinder 100 along the axial direction of the impression cylinder 100. There are multiple notched portions (e.g. two in this embodiment) formed at an equal interval in the circumferential direction of the impression cylinder 100. Moreover, inside these notched portions, the impression cylinder 100 includes holding portions such as claws configured to hold a printing object.

On the other hand, in the rotary screen unit 200, a rotary screen 201 is supported on a sub-frame 204 with bearing members 202 and brackets 203 interposed therebetween.

<Structure for Rotationally Driving Rotary Screen>

The rotary screen 201 includes a screen plate 201A and tubular end rings 201B fixed to opposite ends of the screen plate 201A. The screen plate 201A is a cylindrical body being a cylindrical thin plate material through which fine holes are etched in a given pattern.

The end rings 201B are members for reinforcing the screen plate 201A. Multiple (two in this embodiment) notched portions not shown (hereinafter, "end-ring notched portions) and a pin groove not shown are formed in each end ring 201B. The end-ring notched portions are provided at an equal interval in the circumferential direction of the end ring 201B in the outer peripheral surface of an end portion on the opposite side from the screen plate 201A in the axial direction of the end ring 201B. The pin groove is provided between the adjacent end-ring notched portions and formed by cutting the outer peripheral surface in a U-shaped toward the axis. These end rings 201B are supported on the bearing members 202.

The bearing members 202 are tubular members and support the end rings 201B in a detachable manner. Specifically, multiple (two in this embodiment) protruding portions (hereinafter, "bearing-member protruding portions") not shown are formed on each bearing member 202, and a pin not shown is provided thereon as well. The bearing-member protruding portions are provided on the inner peripheral surface of the bearing member 202 on the end ring 201B side in the axial direction thereof at positions given at an equal interval in the circumferential direction (the same interval as that of the end-ring notched portions). Note that the bearing-member protruding portions have a shape that can be fitted in the end-ring notched portions. Moreover, the pin is fixed to one of the bearing-member protruding portions.

Note that in the rotary screen printing press according to this embodiment, the end ring 201B fixed to one end of the screen plate 201A, and the bearing member 202 supporting this end ring 201B serve as a first supporting member. Moreover, the end ring 201B fixed to the other end of the screen plate 201A, and the bearing member 202 supporting this end ring 201B serve as a second supporting member.

According to this structure, the rotary screen 201 is supported on each bearing member 202 as described below. First, each end ring 201B is inserted into the hollow portion of the corresponding bearing member 202 with the end-ring notched portions and the bearing-member protruding portions aligned with each other in the circumferential direction. Thereafter, the rotary screen 201 is turned relative to the bearing member 202 at such positions that the end-ring notched portions and the bearing-member protruding portions do not interfere with each other. Lastly, the rotary screen 201 is axially moved relative to the bearing member 202 with the pin groove and the pin aligned with each other, to bring the pin into engagement with the pin groove. As a result, the rotary screen 201 is supported on the bearing member 202.

The bearing members 202 are rotatably supported on the brackets 203. Each bracket 203 includes a rotary-screen supporting portion 203*a* and a rotary-shaft supporting portion 203*b* as a single integral body (see FIG. 2).

The rotary-screen supporting portion 203*a* has a through-hole, and the bearing member 202 described above is rotatably supported in this through-hole. On the other hand, the rotary-shaft supporting portion 203*b* is formed in a frame shape and provided adjacently to the rotary-screen supporting portion 203*a* (below the rotary-screen supporting portion 203*a* in FIG. 2). This rotary-shaft supporting portion 203*b* has a through-hole formed in a surface thereof expanding perpendicularly to the axial direction of the rotary screen 201. Moreover rotary shafts 205, 306 extending in parallel with the axial direction of the rotary screen 201 are rotatably supported in the through-holes in the rotary-shaft supporting portions 203*b* of the brackets 203 on both sides in the axial direction, respectively (see FIG. 2).

Note that as shown in FIG. 2, tine rotary shaft 205 and the rotary shaft 206 are coupled to each other axially movably by a tubular coupling member 207. Specifically, one end of the rotary shaft 205 is inserted in and fixed to one end of the coupling member 207. Splines are formed on the inner peripheral surface of the other end of the coupling member 207. On the other hand, splines are formed on an end portion of the rotary shaft 206 on the rotary shaft 205 side. With the splines formed on the coupling member 207 and the splines formed on one end of the rotary shaft 206 meshing with each other, a structure is formed in which the rotary shaft 205 and the rotary shaft 206 can slide in the axial direction and rotate together.

Here, a gear 202*a* as a first gear is fixed to the outer peripheral surface of one of the bearing members 202 (the right one in FIG. 2). Further, a gear 205*a* is fixed to the other end of the rotary shaft 205. Furthermore, the gear 202*a* of the one bearing member 202 and the gear 205*a* of the rotary shaft 205 are in mesh with each other with an intermediate gear 208 interposed therebetween, and a gear 209*a* of a drive motor 209 as a driving motor is in mesh with the gear 205*a* of the rotary shaft 205 (see FIG. 1).

Moreover, a gear 202*a* as a second gear is fixed to the outer peripheral surface of the other bearing member 202 (the left one in FIG. 2), while a gear 206*a* is detachably coupled to the other end of the rotary shaft 206 with a clutch 210 interposed therebetween as means for connecting and disconnecting drive. Moreover, the gear 202*a* of the bearing member 202 and the gear 206*a* of the rotary shaft 206 are in mesh with each other with an intermediate gear 208 interposed therebetween.

In this way, the drive of the drive motor 209 is transmitted to one end of the rotary screen 201 through the gear 209*a* of the drive motor 209, the gear 205*a* of the rotary shaft 205, the intermediate gear 208 thereon, the gear 202*a* of the bearing member 202 thereon, and the bearing member 202, and also transmitted to the other end of the rotary screen 201 through the gear 209*a* of the drive motor 209, the gear 205*a* of the rotary shaft 205, the rotary shaft 205, the coupling member 207, the rotary shaft 206, the clutch 210, the gear 206*a* of the rotary shaft 206, the intermediate gear 208 thereon, the gear 202*a* of the bearing member 202 thereon, and the bearing member 202. As a result, the opposite ends of the rotary screen 201 are rotationally driven.

Moreover, the brackets 203 are supported on the sub-frame 204 in such a way as to be slidable in the axial direction of the rotary screen 201. Specifically, a rail not shown extending in the axial direction of the rotary screen 201 is disposed on the sub-frame 204, and the brackets 203 are configured to be movable along this rail. This movement of the brackets 202 is done by utilizing a rotary-screen positioning motor 211.

Specifically, a screw 211*b* configured to rotate with the drive of the rotary-screen positioning motor 211 is formed at the tip of a drive rod 211*a* of the rotary-screen positioning motor 211. On the other hand, a block 236 in which a female screw engageable with the screw 211*b* is formed is fixed to one of the brackets 203 (the right one in FIG. 2). With the screw 211*b* engaged with and fastened to the block 236, the one bracket 203 is moved in the axial direction of the rotary screen 201 as the rotary-screen positioning motor 211 is driven. Here, the other bracket 203 follows the movement of the one bracket 203 and is moved in the axial direction as well, since the other bracket 203 is coupled to the one bracket 203 by the rotary screen 201.

Further, the tip of a tension cylinder 212 is fixed to the other bracket 203. The tension cylinder 212 is provided to adjust the tension of the rotary screen 201 in the axial direction thereof and configured to push the other bracket 203 in the opposite direction from the one bracket 203. Thus, the rotary screen 201 is constantly subjected to tension in the axial direction thereof.

With the above structure described above, the rotary screen 201 can be rotationally driven and put in register in the top-bottom direction.

<Structure for Engaging and Disengaging Rotary Screen and Squeegee>

Further, a squeegee 213 is inserted in the rotary screen 201. The squeegee 213 includes a blade 213A and a squeegee bar 213B (see FIG. 1). The blade 213A is a member configured to supply special ink toward the impression cylinder 100 through the fine holes in the screen plate 201A, i.e. a squeegee body. The squeegee bar 213B is a support supporting the blade 213A and also a member configured to supply the special ink into the inner surface of the screen plate 201A. In the rotary screen printing press, the tip of the blade 213A slides on the inner peripheral surface of the screen plate 201A, so that the special ink supplied into the screen plate 201A through the inside of the squeegee bar 213B is transferred onto the printing surface of a printing object through the fine holes.

Meanwhile, in addition to the structure described above, the sub-frame 204 is further provided with four flanges 204*a*, 204*b*, 204*c*, 204*d* at each end in the axial direction of the rotary screen 201.

Figure 3:
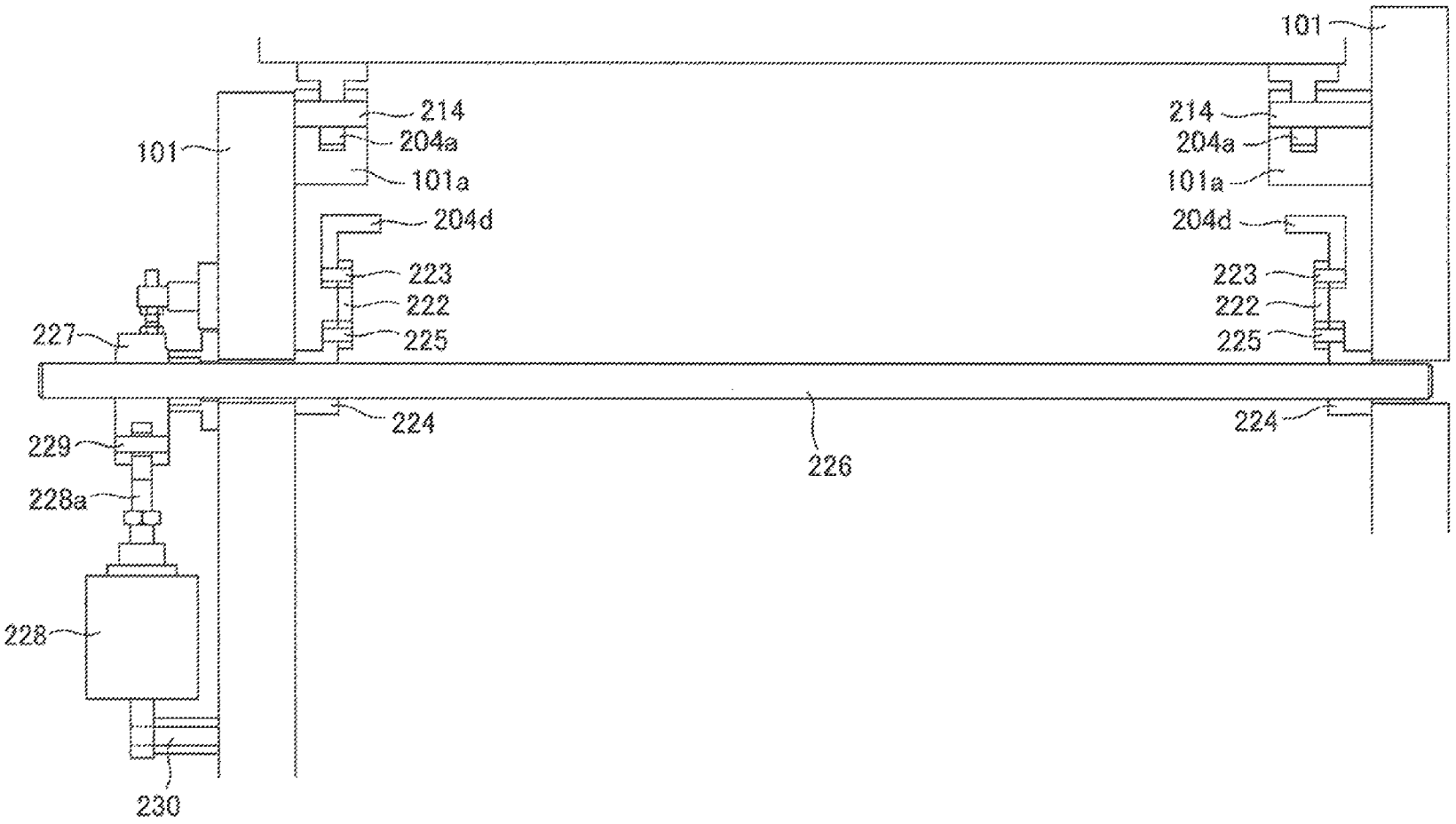
FIG. 3 is an explanatory view showing the relationship between frames and a sub-frame in the rotary screen printing press according to the embodiment of the present invention.

The first flange 204*a* is swingably coupled to a flange 101*a* with a pin 214 interposed therebetween, the flange 101*a* being provided to a frame 101 supporting the impression cylinder 100 (see FIG. 3). The pin 214 is arranged with its axial direction in parallel with the axial direction of the rotary screen 201.

The second flange 204*b* is swingably coupled to the proximal end of a squeegee engagement-disengagement cylinder 215 with a pin 216 interposed therebetween (see FIG. 2). The squeegee engagement-disengagement cylinder 215 is a two-stage cylinder provided to move the squeegee 213 to engagement and disengagement positions and a replacement position to be described later, and swingably coupled at the tip to a supporting plate 217 with a pin 218 interposed therebetween.

Here, a region of the supporting plate 217 is notched in an arc shape to form an arc-shaped notched portion, and a worm 234 is fixed therearound. A squeegee holding member 219 is turnably supported on the arc-shaped notched portion. The squeegee bar 213B is detachably fixed to the squeegee holding member 219.

More specifically, as shown in FIG. 1, the squeegee holding member 219 includes a squeegee holding portion 219A formed in a substantially semi-circular shape in cross section that can be fitted in the arc-shaped notched portion, and a locking plate 219B disposed in such a way as to face a straight portion of the squeegee holding portion 213A. A rectangular groove which can be fitted to the squeegee bar 213B is formed in the center of the straight portion of the squeegee holding portion 219A. The squeegee holding member 219 is configured to fix the squeegee by fitting the squeegee bar 213B into the rectangular groove and closing the opening of the notched portion with the locking plate 219B.

Figure 4:
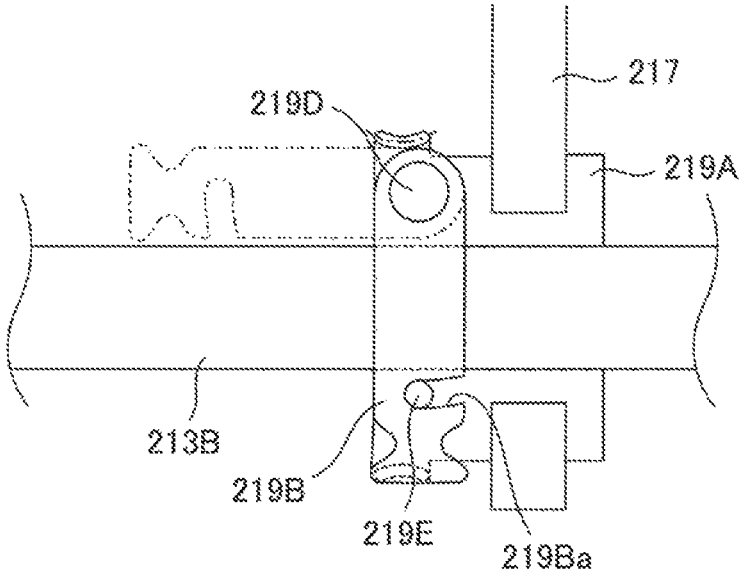
FIG. 4 is an explanatory view showing a squeegee holding member of the rotary screen printing press according to the embodiment of the present invention.

Thus, during printing, the squeegee bar 213B can be fixed by setting the locking plate 219B as illustrated in FIG. 4 with a solid line so that the longitudinal direction of the locking plate 219B can b perpendicular to the longitudinal direction of the squeegee bar 213B. Moreover, for replacement of the squeegee bar 213B or the like, the squeegee bar 213B can be detached by operating a handle 219C to turn the locking plate 219B as illustrated in FIG. 4 with a two-dot chain line so that the longitudinal direction of the locking plate 219B can be in parallel with the longitudinal direction of the squeegee bar 213B.

Here, as shown to FIG. 4, the locking plate 219B is coupled to the squeegee holding portion 219A with a screw 219D interposed therebetween. The squeegee holding portion 219A can be turned by turning the handle 219C (see FIG. 1) fixed to the tip of the screw 219D to loosen the fastening of the squeegee holding portion 219A and the locking plate 219B. Further, a positioning pin 219E is provided on the squeegee holding portion 219A, while a notch 219Ba which engages with the pin 219E is formed in the locking plate 219B. In this way, the locking plate 219B can be easily positioned at the time of locking the squeegee bar 213B with the locking plate 219B.

Further, the above-mentioned worm 234 is in mesh with a worm wheel on the squeegee holding member 219. The squeegee holding member 219 turns along the arc-shaped notched portion of the supporting plate 217 as the worm 234 is turned. In this way, the angle at which the blade 213A contacts the screen plate 201A can be adjusted.

Here, in the rotary screen printing press according to this embodiment, the supporting plate 217 is disposed such that a center $P_1$ of the rotary screen 201, a center $P_2$ of turning movement of the squeegee 213 (squeegee holding member 219), and a point $P_3$ at which the screen plate 201A faces and contacts the impression cylinder 100 (the point of contact between the tip of the blade 213A and the screen plate 201B) are all located along a straight line ($L_1$ shown in FIG. 1) during printing.

According to this structure, to adjust the angle at which the blade 213A contacts the screen plate 201A for the type of ink or the like, the squeegee holding member 219 is turned using the worm 234 to adjust the angle of the blade 213A. Here, since the above-mentioned three points $P_1$, $P_2$, $P_3$ are all located along a straight line, the blade 213A is unlikely to be pressed against the screen plate 201A to an unnecessary extent during the angle adjustment of the blade 213A, and is therefore prevented from damaging the screen plate 201A.

Note that the pin 216 and the pin 218 are arranged with their axial directions in parallel with the axial direction of the rotary screen 201.

The third flange 204*c* is swingably coupled to the supporting plate 217 with a pin 220 and an eccentric sleeve 221 interposed therebetween. A slotted hole 221*a* is formed in the eccentric sleeve 221, and a pin 221*b* fixed to the supporting plate 217 is fitted in this slotted hole 221*a* in such a way as to be slidable along the slotted hole 221*a*. Here, the tip of the blade 213A will be displaced from the contact point $P_3$ if the angle at which the blade 213A contacts the screen plate 201A is adjusted simply by turning the squeegee holding member 219 as described above. For this reason, the eccentric sleeve 221 is given an eccentric design so that the tip of the blade 213A can be moved along a tangent line $L_2$ on the impression cylinder 100 passing the contact point $P_3$, which is shown in FIG. 1. Thus, the displacement of the position of the tip of the blade 213A from the contact point $P_3$ caused by the turning of the squeegee holding member 219 can be corrected with the eccentric sleeve 221.

Note that reference sign 235 shown in FIG. 1 denotes a stopper configured to limit the turning of the supporting plate 217 toward an engagement position. A screw 236 extending with its axial direction perpendicular to the tangent direction of the pin 220 penetrates the stopper 235 in such a way as to be capable of advancing and retracting in the axial direction. The stopper 235 is configured to adjust the pressure of the blade 213A against the impression cylinder 100 in a state where the squeegee 213 is disposed at a squeegee engagement position, by means of the amount of protrusion of the screw 236. Moreover, a surface 217*a* of the supporting plate 217 in contact with the screw 236 is designed to be flush with the tangent line $L_2$. In this way, the pressure of the blade 213A against the screen plate 201A in the state where the squeegee 213 is disposed at the squeegee engagement position can be maintained constant even when the blade 213A is moved along the tangent line L2 by the eccentric sleeve 221. Here, the operator may directly turn the screw 236 to adjust the amount of protrusion of the screw 236, or a gear of a motor not shown may be engaged with the screw 236 and the screw 236 may be turned via a remote operation to adjust the amount of protrusion thereof.

Note that the pin 220 on each side is arranged with its axial direction in parallel with the axial direction of the rotary screen 201.

A first link member 222 is swingably coupled to the fourth flange 204*d* with a pin 223 interposed therebetween (see FIGS. 1 to 3). The first link member 222 is swingably coupled to a second link member 224 with a pin 225 interposed therebetween. The second link member 224 is penetrated by and fixed to a rotary shaft 226.

Here, as shown in FIG. 3, the first link member 222 and the second link member 224 are arranged at the inner side of each of the frames 101. The rotary shaft 226 is arranged with its axial direction in parallel with the axial direction of the rotary screen 201 and penetrates the frames 101 in such a way that at least one end thereof (the left end in FIG. 4) protrudes to the outer side of the corresponding frame 101.

Moreover, the one end of the rotary shaft 226 at the outer side of the frame 101 penetrates and is fixed to a third link member 227. A drive rod 228*a* of a screen-plate engagement-disengagement cylinder 228 is swingably coupled at one end to the third link member 227 with a pin 229 interposed therebetween. The drive rod 228*a* of the screen-plate engagement-disengagement cylinder 228 is swingably coupled at the other end to the frame 101 with a pin 230 interposed therebetween. Note that the pin 223, the pin 225, the pin 229, and the pin 230 are arranged with their axial directions in parallel with the axial direction of the rotary screen 201.

With, the above-described structure, the rotary screen printing press according to this embodiment controls the positions of the rotary screen 201 and the squeegee 213. First, the position of the squeegee 213 relative to the inner periphery of the rotary screen 201 can be controlled with each squeegee engagement-disengagement cylinder 215. Specifically, as the squeegee engagement-disengagement cylinder 215 is extended, the corresponding supporting plate 217 is swung (counterclockwise in FIG. 1) while pivotally supported on the pin 218 and the pin 220, and the squeegee 213 is moved to the squeegee engagement position together with the supporting plate 217. Moreover, as the squeegee engagement-disengagement cylinder 215 is retracted, the supporting plate 217 is swung (clockwise in FIG. 1) while pivotally supported on the pin 218 and the pin 220, and the squeegee 213 is moved to a squeegee disengagement position together with the supporting plate 217. As the squeegee engagement-disengagement cylinder 215 is further retracted, the supporting plate 217 is swung (clockwise in FIG. 1) while pivotally supported on the pin 218 and the pin 220, and the squeegee 213 is moved to a squeegee replacement position together with the supporting plate 217.

Note that the squeegee engagement position mention here is a position at which the tip of the blade 213A contacts the inner peripheral surface of the screen plate 201A, i.e. a position at which printing is performed. Moreover, the squeegee disengagement position is a position at which the tip of the blade 213A is separated from the inner peripheral surface of the screen plate 201A in order to, for example, avoid the above-mention claws of the impression cylinder 100 during printing. Furthermore, the squeegee replacement position is a position to which the squeegee 213 is retreated to be closer to the axis of the rotary screen 201 for replacement of the screen plate 201A or after finishing printing, for example.

Moreover, the positions of the rotary screen 201 and the squeegee 213 can be controlled together by using the screen-plate engagement-disengagement cylinder 228. Specifically, as the screen-plate engagement-disengagement cylinder 228 is retracted, the whole sub-frame 204 is swung (counterclockwise in FIG. 1) through the third link member 227, the second link member 224, and the first link member 222, thereby moving the rotary screen 201 to a rotary-screen engagement position through the brackets 203 and also moving the squeegee 213 to the rotary-screen engagement position through the supporting plates 203. Moreover, as the screen-plate engagement-disengagement cylinder 228 is extended, the whole sub-frame 204 is swung (clockwise in FIG. 1) through the third link member 227, the second link member 224, and the first link member 222, thereby moving the rotary screen 201 to a rotary-screen disengagement position through the brackets 203 and also moving the squeegee 213 to the rotary-screen disengagement position through the supporting plates 203.

Note that the rotary-screen engagement position mentioned here is a position at which the screen plate 201A contacts the impression cylinder 100, in other words, a position at which a printing object is printed by the rotary screen 201. The rotary-screen disengagement position is a position at which the rotary screen 201 is separated from the impression cylinder 100 after finishing printing or for replacement of the rotary screen, for example.

By the above operations, the rotary screen 201 and the squeegee 213 can be moved together to their engagement and disengagement positions.

<Structure for Replacing Squeegee>

Further, as shown in FIGS. 1 and 2, a slide rail 231 is provided above the rotary screen 201. The slide rail 231 extends in the axial direction of the rotary screen 201 and is supported on the frames 101 on the opposite side of the impression cylinder 100 from the rotary screen 201. This slide rail 231 includes a fixed rail 231A, an intermediate rail 231B, and a movable rail 231C.

The fixed rail 231A is fixed to the frames 101. The intermediate rail 231B is supported on the fixed rail 231A in such a way as to be slidable in the axial direction of the rotary screen 201. The movable rail 231C is supported on the intermediate rail 231B in such a way as to be slidable in the axial direction of the rotary screen 201. In other words, the intermediate rail 231B is slidably coupled to both the fixed rail 231A and the movable rail 231C. Note that this slide rail 231 is a guide rail having a similar structure to that of the slide rail disclosed in Patent Literature 2, for example, and configured to extend and retract in the longitudinal direction. Thus, detailed description thereof is omitted here.

Further, a squeegee bearing arm 232 is turnably supported at one end of the movable rail 231C (the left end in FIG. 2) with a hinge 233 interposed therebetween.

Figure 6:
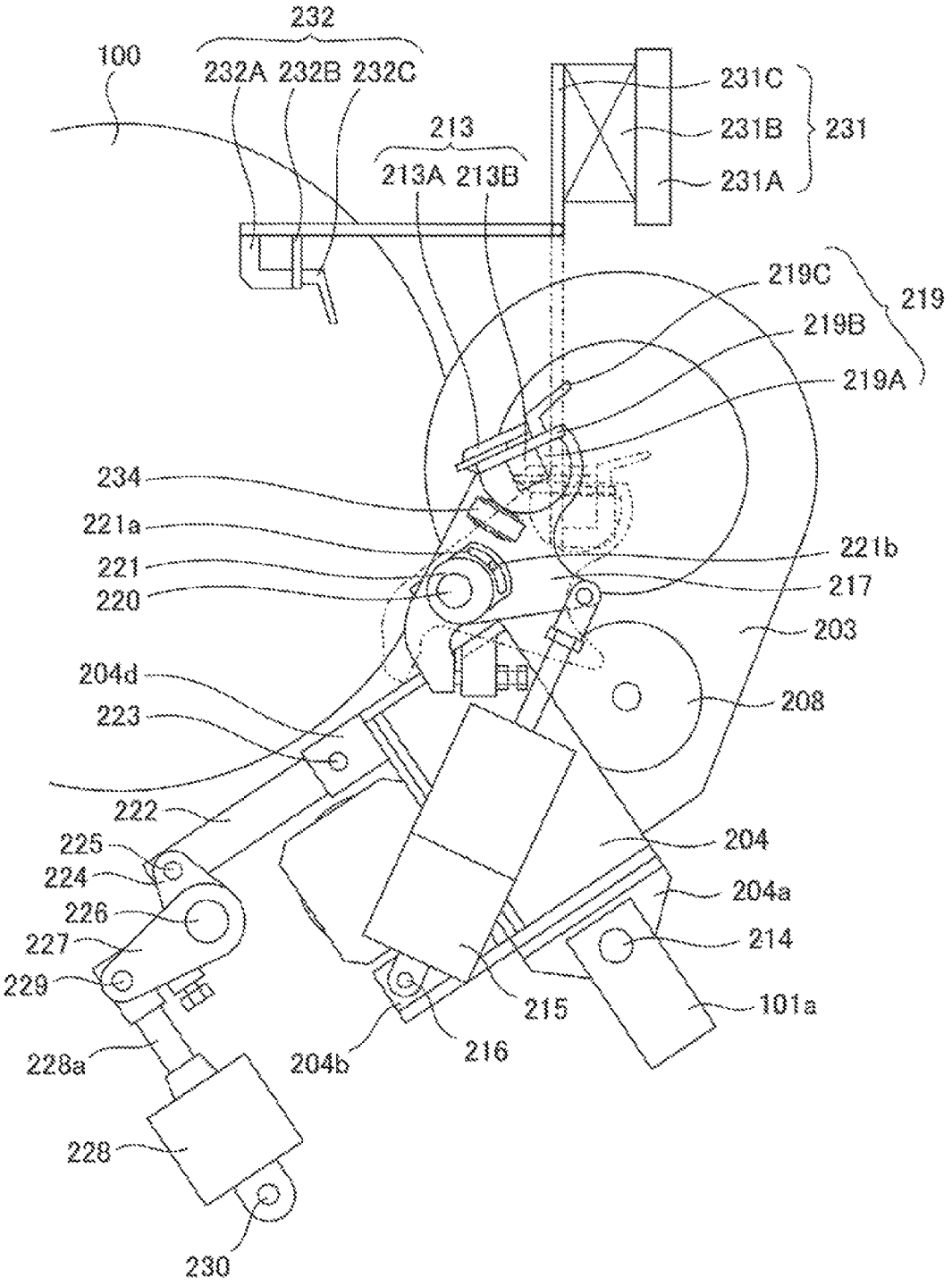
FIG. 6 is an explanatory view describing movement of a squeegee and movement of a squeegee bearing arm in the rotary screen printing press according to the embodiment of the present invention.

The squeegee bearing arm 232 is turnable between a work position and a retreat position about an axis which is in parallel with the axial direction of the rotary screen 201. This squeegee bearing arm 232 is provided at the other end with a squeegee supporting portion 232A, a locking plate 232B, a handle 232C, squeegee raising-lowering means not shown, and a grip 232D. Note that the work position mentioned here is a position at which the squeegee 213 is put into and out of the rotary screen 201 (a position illustrated in FIG. 6 with two-dot chain lines), while the retreat position is a position at which the squeegee bearing arm 232 does not obstruct work during printing (a position illustrated in FIG. 6 with solid lines).

The squeegee supporting portion 232A is formed in an L-shape so that the squeegee supporting portion 232A at the work position can be fitted to a side surface and the lower surface of the squeegee bas 213B which has a rectangular shape in cross section.

The locking plate 232B is configured to fix the squeegee bar 213B housed in the squeegee supporting portion 232A by closing an opening portion thereof facing the upper surface of the squeegee bar 213B. Note that the locking plate 232B is coupled to the squeegee supporting portion 232A with a screw not shown interposed therebetween, and the locking plate 232B can be turned by turning the handle 232C fixed to the tip of the screw to loosen the fastening of the squeegee supporting portion 232A and the locking plate 232B. Thus, for replacement of the squeegee bar 213B or the like, the squeegee bar 213B can be detached from or attached to the squeegee supporting portion 232A by turning the locking plate 232B to open the opening portion facing the upper surface of the squeegee bar 213B.

The squeegee raising-lowering means is means for moving the squeegee supporting portion 232A and the locking plate 232B together in the longitudinal direction of the squeegee bearing arm 232. The squeegee raising-lowering means may be one supporting the squeegee supporting portion 232A on the squeegee bearing arm with a feed screw interposed therebetween, and using a manually turned handle or a motor to rotate this feed screw. Alternatively, the squeegee raising-lowering means may be an air cylinder coupling the squeegee supporting portion 232A and the squeegee bearing arm 232. Note that reference sign 232D in FIG. 2 denotes a grip.

With the above-described structure, the squeegee bearing arm 232 can be moved along the horizontal rail between a nearby position near one of the frames 101 and a separated position separated from the frame 101. Note that the length of the slide rail 231 is set such that the distance between the squeegee bearing arm 232 and the frame 101 is longer than the squeegee bar 213B when the squeegee bearing arm 232 is moved to the separated position. Meanwhile, the squeegee bearing arm 232 is movable between the work position at which the squeegee supporting portion 232A and the locking plate 232B face the other end of the rotary screen 201, and the retreat position at which the squeegee supporting portion 232A and the locking plate 232B are retreated from the other end of the rotary screen 201. Here, since the axis of swinging movement of the squeegee bearing arm 232 is in parallel with the axial direction at the rotary screen 201, the squeegee bearing arm 232 can be swung along the side surface of the frame 101. Accordingly, even when positioned at the retreat position, the squeegee bearing arm 232 does not greatly protrude from the side surface of the frame 101 and does not therefore obstruct the operator.

The above is the structure for replacing the squeegee 213.

Now, procedures of work in the rotary screen printing press according to this embodiment will be described with reference to FIG. 5.

Figure 5:
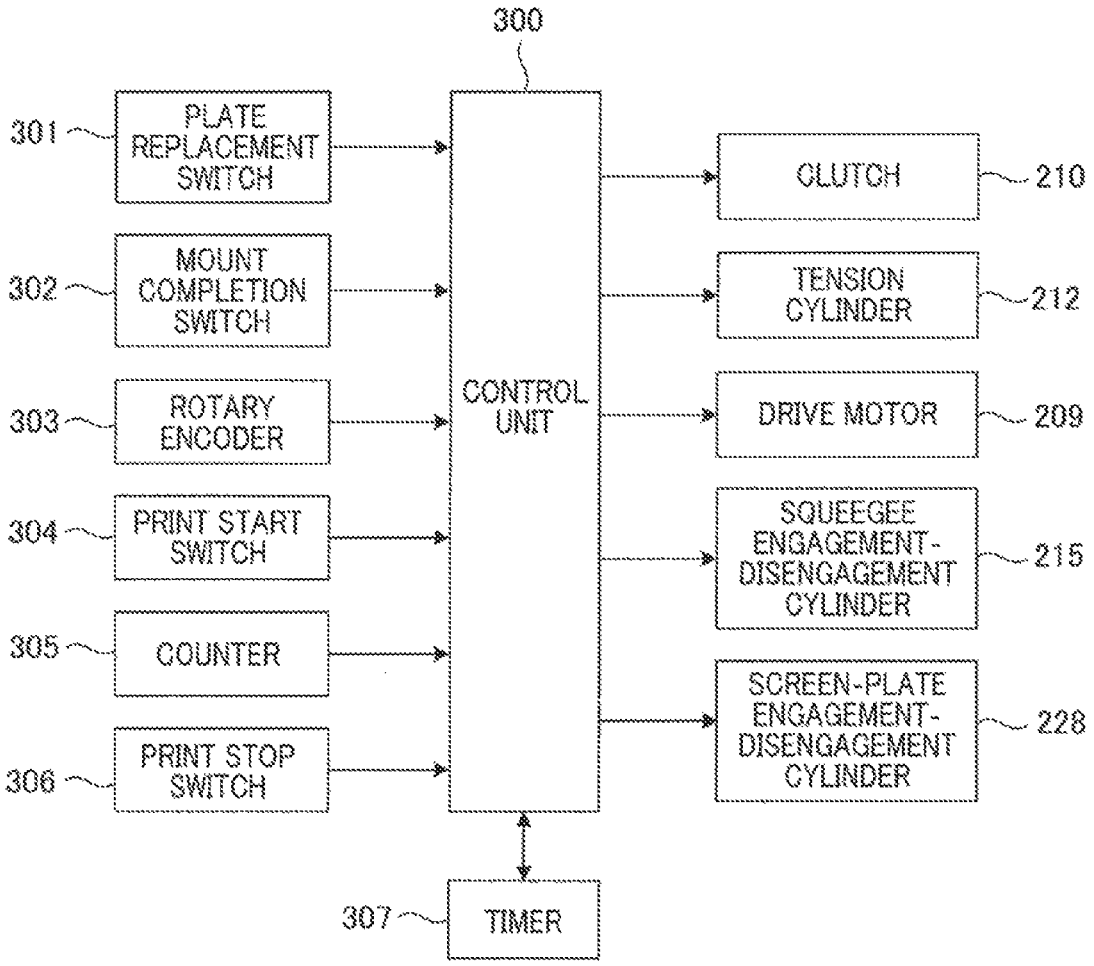
FIG. 5 is a block diagram showing the configuration of the rotary screen printing press according to the embodiment of the present invention.

As shown in FIG. 5, a control unit 300 of the rotary screen printing press according to this embodiment receives operation signals from a plate replacement switch 301, a mount completion switch 302, a rotary encoder 303, a print start switch 304, a counter 305, and a print stop switch 306, and also receives a detection signal from a timer 307.

Moreover, the control unit 300 is configured to control drive of the clutch 210, the tension cylinder 212, the drive motor 209, the squeegee engagement-disengagement cylinder 215, the screen-plate engagement-disengagement cylinder 228, and the time 307.

Hereinbelow, a procedure for replacing the rotary screen 201 of the rotary screen printing press according to this embodiment will be described.

First, when the operator operates the plate replacement switch 301, the control unit 300 outputs a command to the clutch 210 to release (OFF) its connection to the rotary shaft 226, and also outputs an OFF command to the tension cylinder 212.

When the tension cylinder 212 it turned off, the operator releases the engagement of the work-side (left in FIG. 2) bearing member 202 and the work-side end ring 201B and moves the work-side bearing member 202 to the outer aide. Thereafter, the operator releases the engagement of the drive-side (right in FIG. 2) bearing member 202 and the drive-side end ring 201B, removes the used plate, and attaches the ring rings 201B to the opposite ends of a new screen plate 201A. Then, the operator attaches the drive-side end ring 201B on the new screen plate 201A to the drive-side bearing member 202. Thereafter, the operator moves the work-side bearing member 202 to the inner side, turns the new screen plate 201A for phase alignment wits the work-side end ring 201B on the new screen plate 201A, and attaches the end ring 201B to the bearing member 202. Then, the operator turns on the mount completion switch 302.

When the mount completion switch 302 is operated, the control unit 300 outputs commands to turn on the tension cylinder 212, to turn on the drive motor 209, and also to start timing with the timer 307. As a result, the rotary screen 201 is set to a tensioned state, and the rotary screen 201 and the rotary shaft 200 are rotationally driven. Further, the gear 206*a* of the rotary shaft 206 is rotated with the rotation of the rotary screen 201, and the rotary shaft 206 is rotated with the rotation of the rotary shaft 205. Here, since the connection of the clutch 210 to the rotary shaft 226 has been released, the rotation of the gear 206*a* of the rotary shaft 206 and the rotation of the rotary shaft 206 are independent of each other.

Thereafter, after the timer 307 measures a first set period of time which is set in advance, the control unit 300 outputs an ON command to the clutch 210 to connect to the rotary shaft 206. As a result, the gear 206*a* of the rotary shaft 206 is connected to the rotary shaft 206, so that the opposite ends of the rotary screen 201 are now rotationally driven by the drive motor 209.

Then, after the time 307 measures a second set period of time, the control unit 300 outputs a stop command to the drive motor 209, and the replacement of the rotary screen 201 ends.

By performing the above-described operations, even in a case where the reference positions of the end rings 201B and the screen plate 201A in the circumferential direction are somewhat offset from each other when the end rings 201B are attached to the screen plate 201A, the screen plate 201A is unlikely to be out of register on the drive side and the work-side when the opposite ends of the rotary screen 201 are rotationally driven by the drive motor 209. Accordingly, print quality deterioration can be prevented. Furthermore, by connecting the clutch 210 after one side of the rotary screen 201 is driven for a given period of time by the drive motor 209, misregistration on the left and right sides due to backlash can be prevented.

Next, control on the positions of she rotary screen 201 and the squeegee 213 of the rotary screen printing press according to this embodiment will be described.

First, the control unit 300 outputs ON commands to the squeegee engagement-disengagement cylinder 215 and the screen-plate engagement-disengagement cylinder 228 when the control unit 300 receives an operation signal from the print start switch 304 and then receives a detection signal from the rotary encoder 303 indicating that a print start phase for the first sheet (printing object) is reached. As a result, the rotary screen 201 and the squeegee 213 are moved to the rotary-screen engagement position, and the squeegee 213 is moved inside the rotary screen 201 to the squeegee engagement position.

Thereafter, when the control unit 300 receives a detection signal from the rotary encoder 303 indicating that an impression-cylinder-notch start phase is reached, the control unit 300 outputs an OFF command to the squeegee engagement-disengagement cylinder 215. As a result, the squeegee 213 is moved to the disengagement position.

Thereafter, when the control unit 300 receives a detection signal from the rotary encoder 303 indicating that an impression-cylinder-notch end phase is reached, the control unit 300 outputs an ON command to the squeegee engagement-disengagement cylinder 215. As a result, the squeegee 213 is set back to the squeegee engagement position. During printing, the above-described movement of the squeegee 213 between the squeegee engagement position and the squeegee disengagement position is repeated.

Then, when the control unit 300 receives an operation signal from the print stop switch 306 and then receives a detection signal from the rotary encoder 303 indicating that a last-sheet print completion phase is reached, the control unit 300 outputs OFF commands to the squeegee engagement-disengagement cylinder 215 and the screen-plate engagement-disengagement cylinder 228. On the other hand, in a case where the control unit 300 receives no operation from the print stop switch 306, the control unit 300 monitors the signal from the counter 303. Then, the control unit 300 outputs OFF commands to the squeegee engagement-disengagement cylinder 215 and the screen-plate engagement-disengagement cylinder 228 when a predetermined period of time set in advance elapses and the control unit 300 receives a detection signal from the rotary encoder 303 indicating that the last-sheet print completion phase is reached. As a result, the rotary screen 201 and the squeegee 213 are moved to the rotary-screen disengagement position, and the squeegee 213 is moved inside the rotary screen 201 to the squeegee disengagement position.

Not that the ON command for the squeegee engagement-disengagement cylinder 215 instructs the squeegee engagement-disengagement cylinder 215 to perform an operation to move the blade 213A to the squeegee engagement position, while the OFF command for the squeegee engagement-disengagement cylinder 215 instructs the squeegee engagement-disengagement cylinder 215 to perform an operation to move the blade 213A to the squeegee disengagement position. Moreover, the ON command for the screen-plate engagement-disengagement cylinder 228 instructs the screen-plate engagement-disengagement cylinder 228 to perform an operation to move the rotary screen 201 and the squeegee 213 to the rotary-screen engagement position, while the OFF command for the screen-plate engagement-disengagement cylinder 228 instructs the screen-plate engagement-disengagement cylinder 228 to perform an operation to move the rotary screen 201 and the squeegee 213 to the rotary-screen disengagement position.

By performing the above-described operations, the rotary screen 201 and the squeegee 213 can be moved together between the print position (rotary-screen engagement position) and the retreat position (rotary-screen disengagement position). Specifically, in the rotary screen printing press according to this embodiment, each supporting plate 217 supporting the squeegee 213 in such a way that the squeegee 213 can engage with and disengage from the inner periphery of the screen plate 201A, is supported on the sub-frame 204 supporting the screen plate 201A with the brackets 203 interposed therebetween. Thus, when the rotary screen 201 is positioned at the print position or the retreat position with the screen-plate engagement-disengagement cylinder 228, the squeegee 213 and the rotary screen 201 can be moved together at the same time.

In this way, the time taken to move the rotary screen 201 and the squeegee 213 can be shortened, and therefore the squeegee 213 and the rotary screen 201 can be moved together to the retreat position immediately after printing is finished. Accordingly, the possibilities of the ink on the rotary screen 201 adhering to the impression cylinder 100 and of other similar problems are eliminated. In contrast, in the conventional case, it is necessary to firstly move the squeegee 213 toward the axis of the rotary screen 201 and then move the rotary screen 201 to the retreat position. Thus, there is a possibility that the rotary screen 201 may directly contact the impression cylinder 100 after printing is finished, and the ink on the rotary screen 201 may adhere to the impression cylinder 100.

Further, by employing the above-described structure in which the supporting plates 217 are supported on the sub-frame 204, the left and right positions at which the supporting plates 207 support the squeegee 213 can be closer to each other. In this way, it is possible to minimize the length of the squeegee 213 and therefore reduce the weight of the squeegee 213. Accordingly, the burden on the operator can be reduced significantly.

Next, procedures for attaching and detaching of the squeegee 213 of the rotary screen printing press according to this embodiment will be described.

First, to attach the squeegee 213, the squeegee bearing arm 232 is positioned at the separated position in the axial direction of the rotary screen 201 and also positioned at the work position in the circumferential direction about the axis which is in parallel with the axial direction of the rotary screen 201. Then, one end of the squeegee bar 213B is inserted into the squeegee supporting portion 232A from the opening portion thereof.

Thereafter, the opening portion is closed with the locking plate 232B to fix the squeegee bar 213B housed in the squeegee supporting portion 232A, so that the squeegee 213 is supported at the one end. Then, the squeegee 213 is raised with the squeegee raising-lowering means through the squeegee supporting portion 232A and the fixing portion 232B, and the squeegee bearing arm 232 is moved in the axial direction of the rotary screen 201 to the nearby position. When the squeegee bearing arm 232 is moved toward the nearby position, the slide rail 231 retracts to guide the squeegee bearing arm 232.

After the squeegee bearing arm 232 is positioned at the nearby position, the squeegee 213 is lowered with the squeegee raising-lowering means. When the squeegee bar 213B is fitted into the rectangular grooves in the left and right squeegee holding members 219, the lowering of the squeegee 213 with the squeegee raising-lowering means is temporarily stopped. The locking plate 232B is then operated to open the opening portion, and thereafter the lowering of the squeegee 213 with the squeegee raising-lowering means is resumed. As a result, the squeegee supporting portion 232A is lowered, and the squeegee bar 213B is detached from the squeegee supporting portion 232A. Thereafter, the locking plates 219B of the left and right squeegee holding members 219 are turned to close the opening portions of the rectangular grooves in the left and right squeegee holding members 219 with the locking plates 213B, and the handles 219C are turned to fix the squeegee bar 213B inside the rectangular grooves.

Thereafter, the squeegee bearing arm 232 is position at the retreat position about the axis which is in parallel with the axial direction of the rotary screen 201. In this way, the squeegee bearing arm 232 does not obstruct visual check on the state of the ink on the rotary screen 201 through the opening at the end of the rotary screen 201 or access to the inside of the rotary screen 201. Accordingly, check, adjustment, and maintenance work can be performed easily.

On the other hand, to detach the squeegee 213, the opposite work to the attachment of the squeegee 213 are performed. Specifically, the squeegee holding members 219 are positioned at the replacement position, and the locking plates 213B are turned to open the upper openings of the rectangular grooves in the left and right squeegee holding members 219. Thereafter, the squeegee bearing arm 232 is positioned from the retreat position to the work position. In this step, the squeegee supporting portion 232A is located lower than the squeegee 213 supported on the squeegee holding members 219. Then, the squeegee 213 is raised with the squeegee raising-lowering means. When the squeegee bar 213B is fitted into the squeegee supporting portion 232A, the raising of the squeegee 213 with the squeegee raising-lowering means is temporarily stopped. Then, the locking plate 232B is operated to close the opening portion, and the raising of the squeegee 213 with the squeegee raising-lowering means is resumed. As a result, the squeegee bar 213B is detached from the rectangular grooves in the squeegee holding members 219.

After the squeegee bar 213B is raised to a position separated from the squeegee holding members 219, the raising of the squeegee 213 with the squeegee raising-lowering means is stopped, and the squeegee bearing arm 232 is moved from the nearby position to the separated position. When the squeegee bearing arm 232 is moved toward the separated position, the slide rail 231 extends to guide the squeegee bearing arm 232.

During the movement of the squeegee bearing arm 232 to the nearby position or the separated position, the squeegee 213 is passed through the inside of the rotary screen 201. Here, since the openings of the end rings 201B of the rotary screen 201 have a large diameter, the squeegee 213 does not contact the end rings 201B. Moreover, since raised by the squeegee raising-lowering means, the squeegee 213 does not contact any of the squeegee holding members 219 (the worm wheels formed in a fan shape) positioned at the replacement position. Accordingly, the squeegee 213, the end rings 201B, and the squeegee holding members 219 do not get damaged.

Moreover, since the squeegee 213 is downsized and therefore light in weight, the operator can easily lift the squeegee 213 and attach and detach the squeegee bar 213B to and from the squeegee supporting portion 232A of the squeegee bearing arm 232. Further, by providing the extendable-retractable slide rail 231 which supports the squeegee bearing arm 232 at one end, the squeegee 213 can be easily put into and out of the rotary screen 201.

By using the slide rail 231 capable of supporting the squeegee bearing arm 232 at one end, neither the squeegee bearing arm 232 nor the slide rail 231 hardly protrudes to the outer side of the frame 101 when the squeegee bearing arm 232 is positioned at the nearby position. Accordingly, the squeegee bearing arm 232 and the slide rail 231 do not obstructs work.

With the squeegee bearing arm 232 and the slide rail 231 having the above-described structure, replacement work of the squeegee can be done by a single operator.

Note that in the rotary screen printing press according to this embodiment described above, motors may be used instead of the cylinders, namely the squeegee engagement-disengagement cylinder 215 provided to move the squeegee 213 to the engagement and disengagement positions and the retreat position, and the screen-plate engagement-disengagement cylinder 228 provided to move the rotary screen 201 and the squeegee 213 between the print position and the retreat position.

INDUSTRIAL APPLICABILITY

The present invention is preferably applicable to a rotary screen printing press which performs screen printing by using a cylindrical screen plate.

REFERENCE SIGNS LIST

100 IMPRESSION CYLINDER
101 FRAME
200 ROTARY SCREEN UNIT
201 ROTARY SCREEN
201A SCREEN PLATE
201B END RING
202 BEARING MEMBER
202*a* GEAR OF BEARING MEMBER
203 BRACKET
203*a* ROTARY-SCREEN SUPPORTING PORTION
203*b* ROTARY-SCREEN SUPPORTING PORTION
204 SUB-FRAME
204*a* FIRST FLANGE
204*b* SECOND FLANGE
204*c* THIRD FLANGE
204*d* FOURTH FLANGE
205, 206 ROTARY SHAFT
205*a*, 206*b* GEAR OF ROTARY SHAFT
207 COUPLING MEMBER
208 INTERMEDIATE GEAR
209 DRIVE MOTOR

209*a* GEAR OF DRIVE MOTOR
210 CLUTCH
211 ROTARY-SCREEN POSITIONING MOTOR
211*a* DRIVE ROD
211*b* SCREW
212 TENSION CYLINDER
213 SQUEEGEE
213A BLADE
213B SQUEEGEE BAR
214, 216, 218, 220, 223, 225, 229, 230 PIN
215 SQUEEGEE ENGAGEMENT-DISENGAGEMENT CYLINDER
217 SUPPORTING PLATE
217*a* CONTACT SURFACE
219 SQUEEGEE HOLDING MEMBER
219A SQUEEGEE HOLDING PORTION
219B LOCKING PLATE
219Ba NOTCH
219C HANDLE
219D SCREW
219E PIN
221 ECCENTRIC SLEEVE
221*a* SLOTTED HOLE
221*b* PIN
222 FIRST LINK MEMBER
224 SECOND LINK MEMBER
226 ROTARY SHAFT
227 THIRD LINK MEMBER
228 SCREEN-PLATE ENGAGEMENT-DISENGAGEMENT CYLINDER
228*a* DRIVE ROD
231 SLIDE RAIL
231*a* FIXED RAIL
231*b* INTERMEDIATE RAIL
231*c* MOVABLE RAIL
232 SQUEEGEE BEARING ARM
232A SQUEEGEE SUPPORTING PORTION
232B LOCKING PLATE
233 HINGE
234 WORM
235 STOPPER
236 SCREW
237 STOPPER

The invention claimed is:

1. A rotary screen printing press, comprising:

screen-plate supporting means for supporting a screen plate formed in a cylindrical shape;

screen-plate engaging-disengaging means for moving the screen-plate supporting means between a print position and a retreat position; and squeegee supporting means for supporting a squeegee in such a way that the squeegee is engageable with and disengageable from an inner periphery of the screen plate, wherein the screen-plate supporting means includes a sub-frame supporting opposite ends of the screen plate in an axial direction, and the squeegee supporting means includes supporting plates supporting the squeegee movable between a position at which the squeegee contacts the inner peripheral surface of the screen plate and a position at which the squeegee is separated from the inner peripheral surface of the screen plate, and the supporting plates are supported on the sub-frame.

2. The rotary screen printing press according to claim 1, wherein the supporting plates are swingably coupled to the sub-frame.

* * * * *